US005573246A

United States Patent [19]

Liao

[11] Patent Number: 5,573,246

[45] Date of Patent: Nov. 12, 1996

[54] BUILDING BLOCK-JIGSAW PUZZLE

[76] Inventor: Chi-Yang Liao, P.O. Box 1-394, Chungho, Taipei Hsien, Taiwan

[21] Appl. No.: 446,460

[22] Filed: May 22, 1995

[51] Int. Cl.[6] ..... A63F 9/10

[52] U.S. Cl. ..... 273/157 R; 434/406

[58] Field of Search ..... 273/153 R, 156, 273/157 R, 157 A; 434/368, 369, 406, 403

[56] References Cited

U.S. PATENT DOCUMENTS

| | | | |
|---|---|---|---|
| 1,959,040 | 5/1934 | Schilling | 273/153 R |
| 2,501,520 | 3/1950 | Howard | 273/157 R |
| 4,259,804 | 4/1981 | Samuels | 273/157 R |
| 5,362,054 | 11/1994 | Ashemimry | 434/406 |

FOREIGN PATENT DOCUMENTS

| | | | |
|---|---|---|---|
| 1210452 | 10/1970 | United Kingdom | 273/157 R |
| 2265836 | 10/1993 | United Kingdom | 273/157 R |

*Primary Examiner*—William M. Pierce

[57] ABSTRACT

This invention relates to a building block-jigsaw puzzle which is composed of a plurality layer of building blocks and a case, each layer of.: building blocks being composed of a plurality of divided building blocks which can be combined to form a picture, just like a jigsaw puzzle, the shape of each layer of divided building blocks being different, but they can be combined to form the same picture, the top layer picture showing the outline and title of the article, plant or animal, in the picture, the next layer of building blocks can be combined to show a picture in which the name of every part of the article, plant or animal are illustrated, the lower layer of building blocks can be combined to show the same picture in which the detailed explanation and function of every part of the article, plant or animal are illustrated, each layer of building blocks having respectively a circular building block, between each circular building block and the other building blocks situated around the circular building block having some gaps so that each layer of building blocks can be taken out easily from the gaps to combine the next layer of building blocks can play building block game and jigsaw puzzle in the case, meanwhile the player can, learn some knowledge gradually from each layer of building blocks.

1 Claim, 8 Drawing Sheets

BUILDING BLOCK-JIGSAW PUZZLE

BACKGROUND OF THE INVENTION

1. Field of the Invention

This invention relates to a building block-jigsaw puzzle which is composed of a plurality layer of building blocks and a case, the shape of each layer of divided building blocks being different, but they can be combined to form the same picture, the top layer picture showing the outline and title of the article, plant or animal shown in the picture, the next layer of building blocks can be combined to show the same picture in which the name of every part of the article, plant or animal are illustrated, the lower layer of building blocks can be combined to show the same picture in which the detailed explanation and function of every part of the article, plant or animal are illustrated, in each layer of building blocks having respectively a circular building block, between each circular building block and the other building blocks situated around the circular building block having some gaps so that each layer of building blocks can be taken out easily from the gaps, thus the player can play building block game and jigsaw puzzle in the case, meanwhile the player can learn some knowledge or information gradually from each layer of building blocks.

2. Description of the Prior Art

The conventional building block game and jigsaw puzzle are designed for children playing, but these two kinds of games only can be played respectively, they can'at be combined to play, most of the children would feel boring about playing the games for a long time, furthermore the player only can choose to play building block game or jigsaw puzzle, but can'at learn any information or knowledge from the process of play.

SUMMARY OF THE INVENTION

It is therefore the main object of this invention to provide a building block-jigsaw puzzle which is composed of a plurality layer of building blocks and a case, each layer of building blocks can be composed to form the same picture, the top layer picture showing the outline and title of the article, plant or animal shown in picture, the next layer picture showing the name of every part of the article, plant or animal, the lower layer picture showing the detailed explanation and function of every part of the article, plant or animal, accordingly, the player can play building block game and jigsaw puzzle at the same time, furthermore the player can learn some knowledge gradually from each layer of building blocks.

BRIEF DESCRIPTION OF THE DRAWINGS

In the drawings, which illustrated the preferred embodiments and modes of operation of the invention, and in which like reference characters designate the same or similar parts throughout the several views.

DETAILED DESCRIPTION OF THE PREFERRED EMBODIMENT

Figure 1:
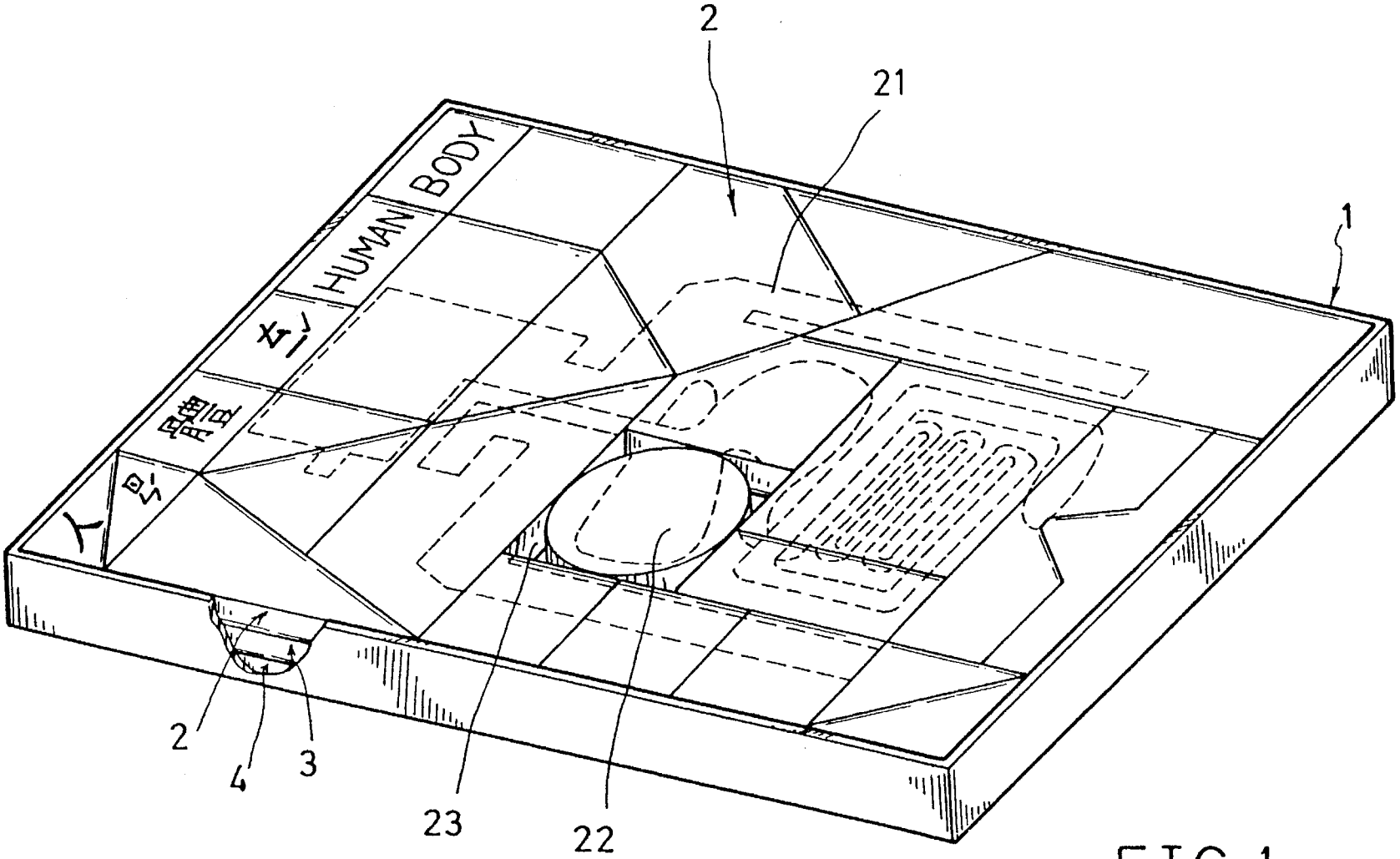
FIG. 1 is a perspective view showing a building block-jigsaw puzzle of the present invention.
Figure 2:
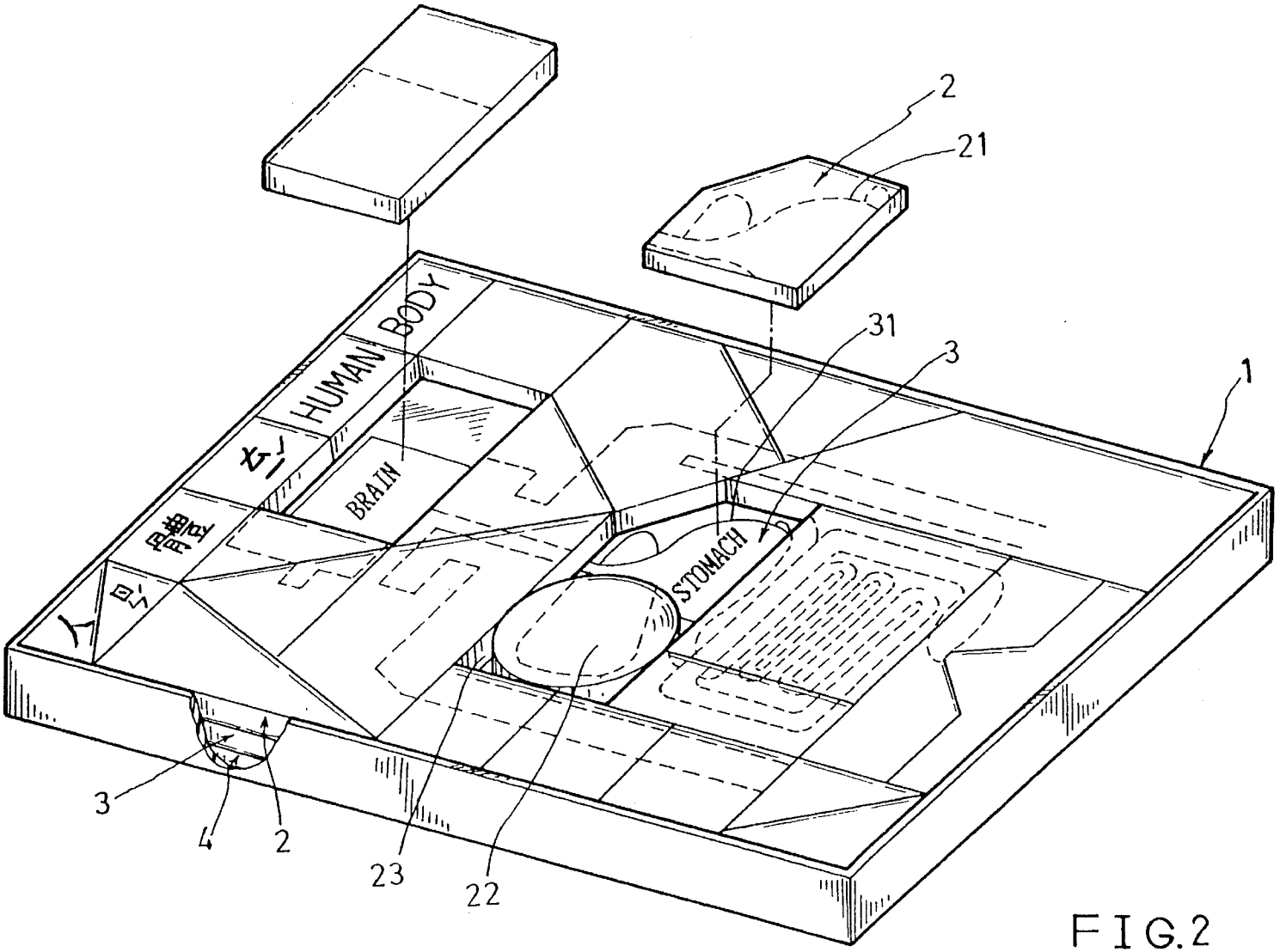
FIG. 2 is a perspective view showing the second building blocks of the invention.
Figure 3:
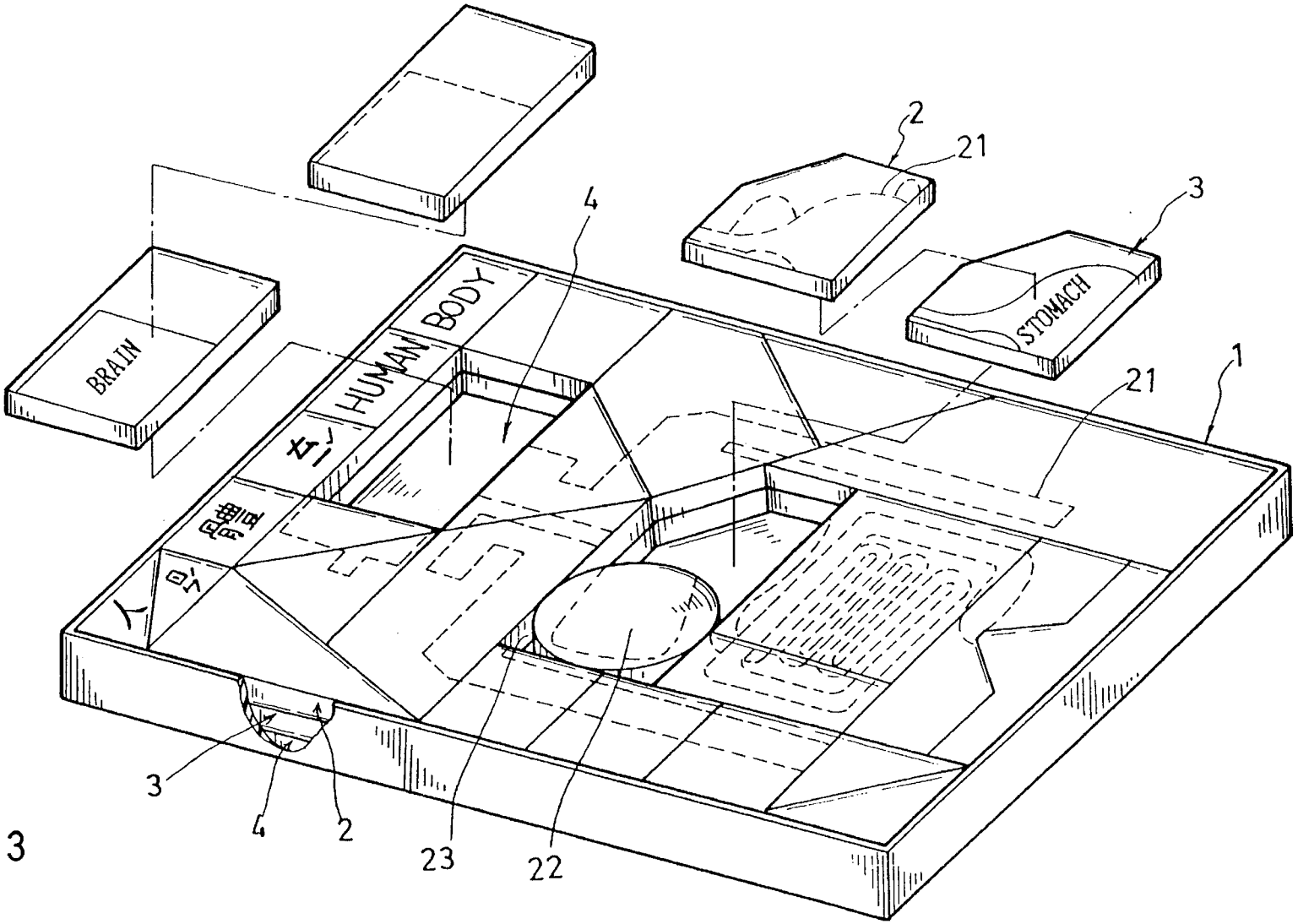
FIG. 3 is a perspective view showing the third building blocks of the invention.
Figure 4:
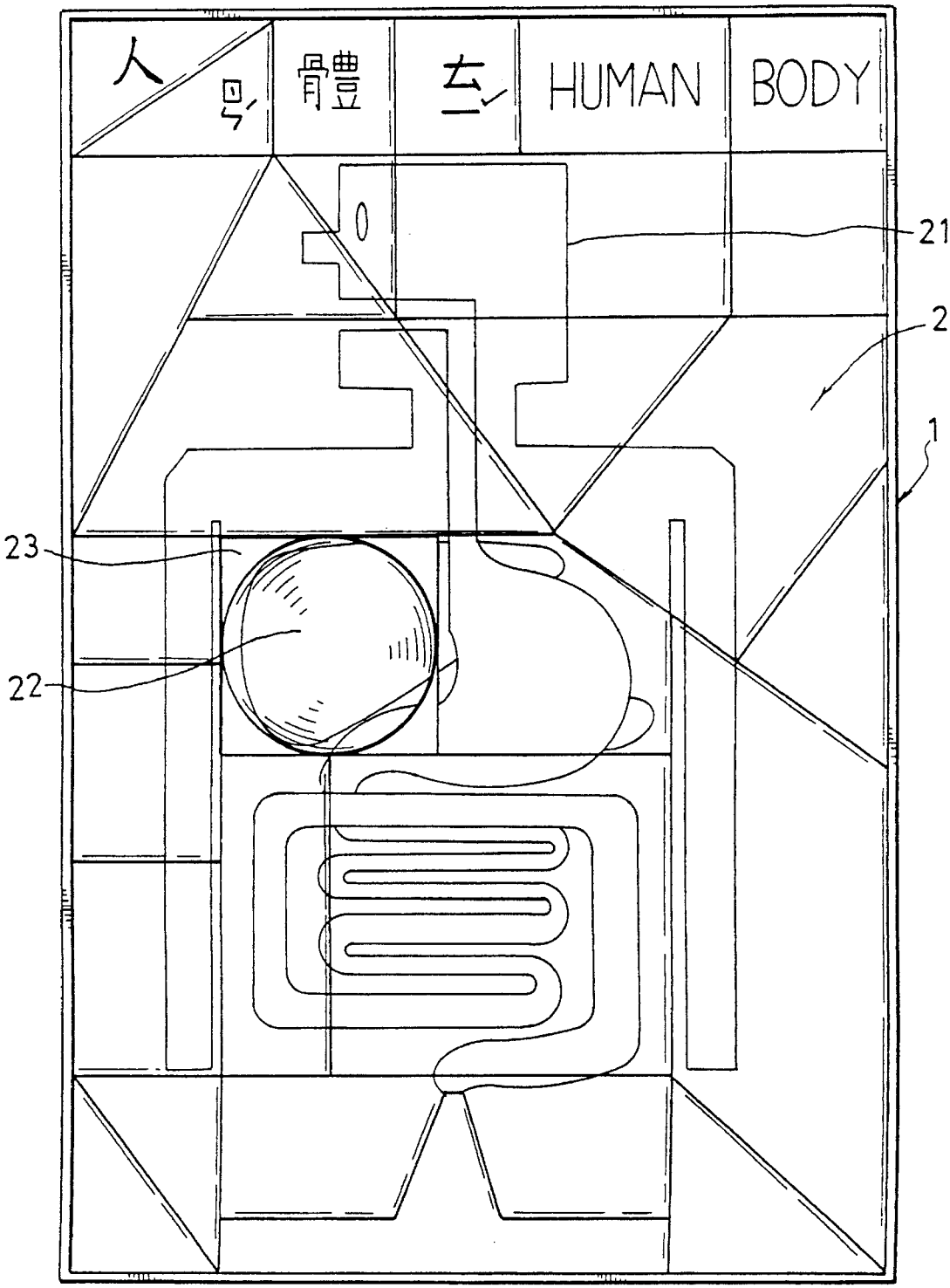
FIG. 4 is a plan view showing an embodiment of the first building blocks of the invention.
Figure 5:
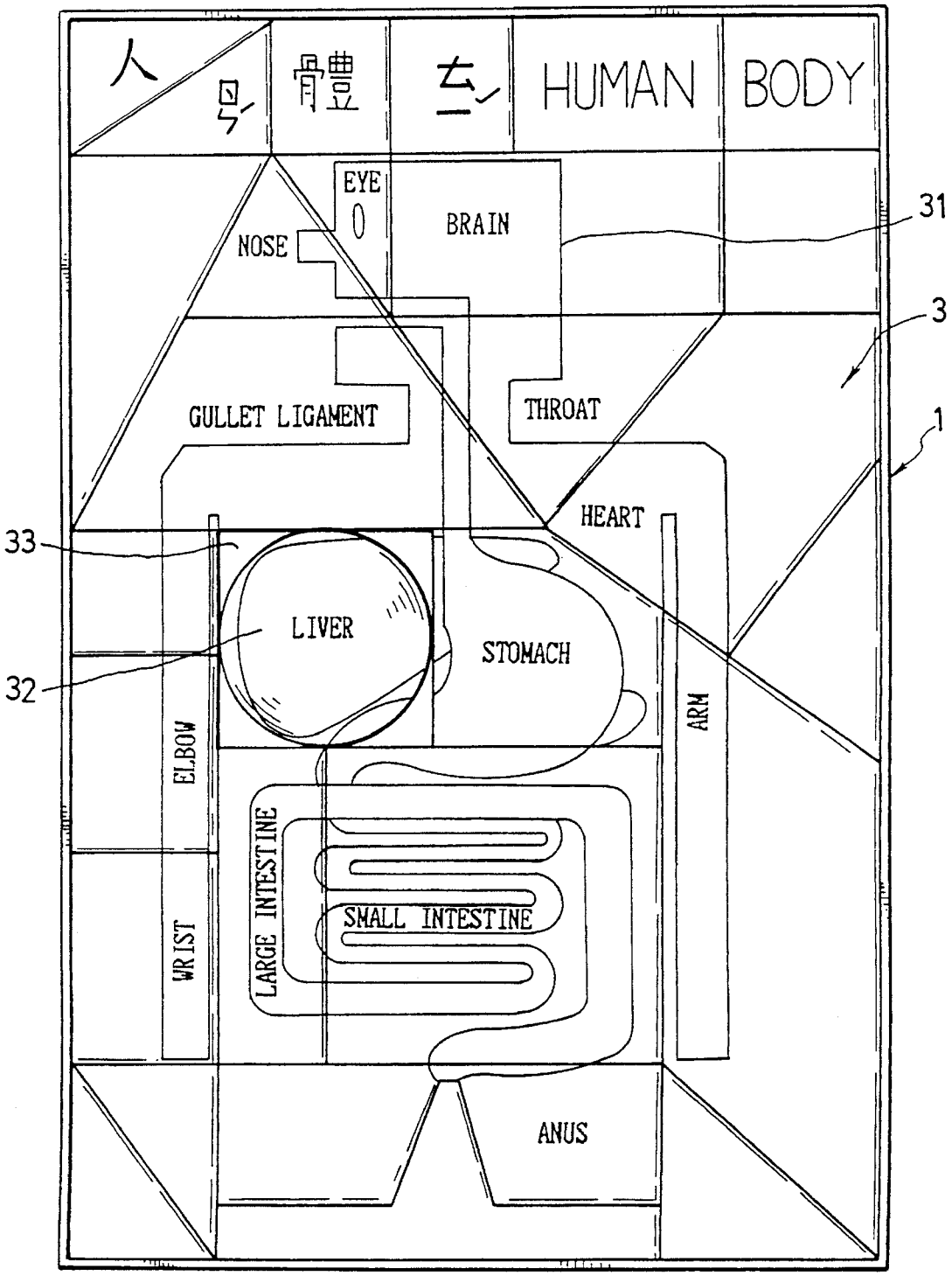
FIG. 5 is a plan view showing the name of every part of a combined picture on the second building blocks.
Figure 6:
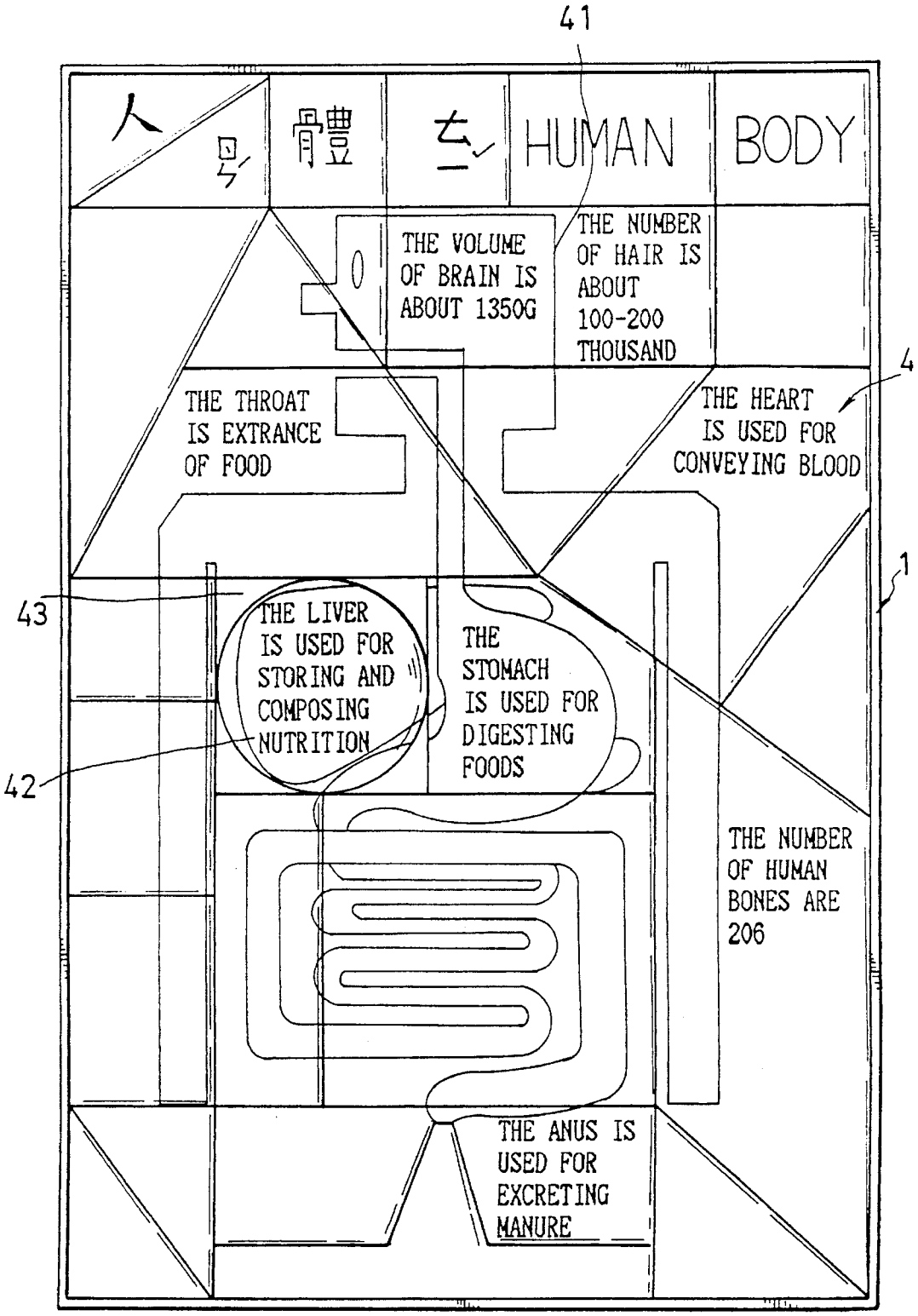
FIG. 6 is a plan view showing the detailed explanation of every part of the combined picture on the third building blocks.

Referring to FIG. 1, FIG. 2 and FIG. 3, the present invention, a building block-jigsaw puzzle, is composed of a case (1), a first layer of building blocks (2), a second layer of building blocks (3) and a third layer of building blocks (4), the shape of each layer of building blocks being different, but they can be combined to form the same picture, the three layer of building blocks can be placed in the case (1). The first layer of building blocks (2) are composed of a plurality layer of building blocks (2) which can be combined to form a picture (21), such as shown in FIG. 4. The second layer of building blocks (3) and the third layer of building blocks (4) both are composed of a plurality layer of building blocks which can be combined to form a picture (31) (41) respectively, the picture (31) combined by the second layer of building blocks (3) showing the name of every part of the human organs, such as shown in FIG. 5, furthermore the picture (41) combined by the third layer of building blocks (4) showing the detailed explanation and function of every part of the human organs, such as shown in FIG. 6.

The building block-jigsaw puzzle have three layer of building blocks, each layer being composed of a plurality of divided building blocks, these building blocks of each layer can be combined to form a picture, respectively, such as a jigsaw puzzle. The three pictures are the same with each other, the first layer picture (21) showing the title of the picture, if the player would like to know the every part of the article or the animal shown in the picture, he can take out the first layer of building blocks (2) and combined the second layer of building b locks (3), then the player can find the name of every part in the second layer picture (31), furthermore the p layer can take out the second layer of building blocks (3) and combined the third layer of building blocks (4), then the player can find the detailed explanation and function of every part illustrated in the third layer picture. in the first layer of building blocks (2), the second layer of building blocks (3) and the third layer of building blocks (4) all having a circular building block (22) (32) (42), respectively, between each circular building block (22) (32) (42) and the other building blocks situated respectively around the circular building block having respectively some gaps (23) (33) (43) so that each layer of building blocks can be taken out easily from these gaps (23) (33) (43). Accordingly, the player can do building block game and jigsaw puzzle, meanwhile the player can learn some knowledge from the game.

Figure 7:
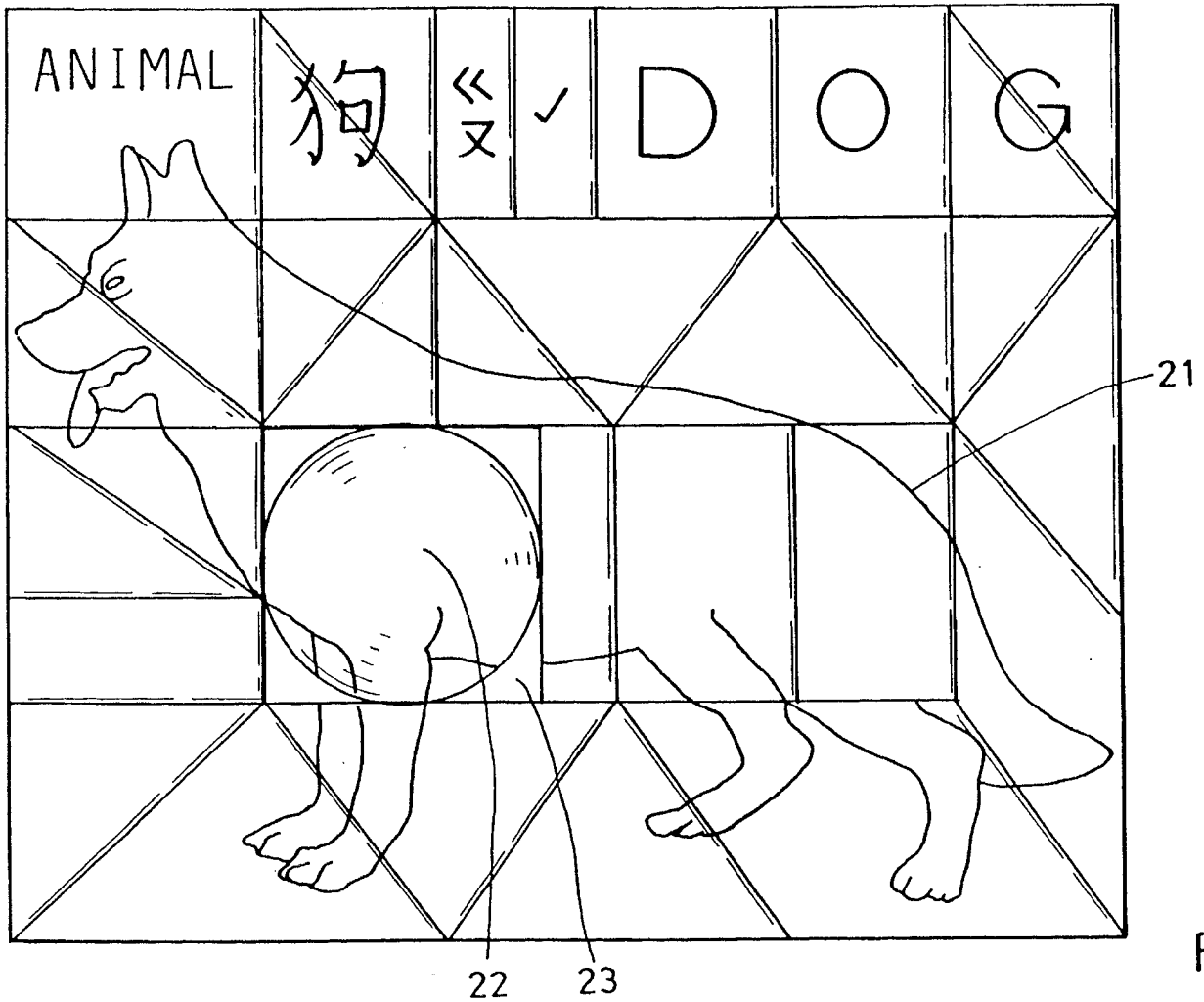
FIG. 7 is a plan view showing another embodiment of this invention.
Figure 8:
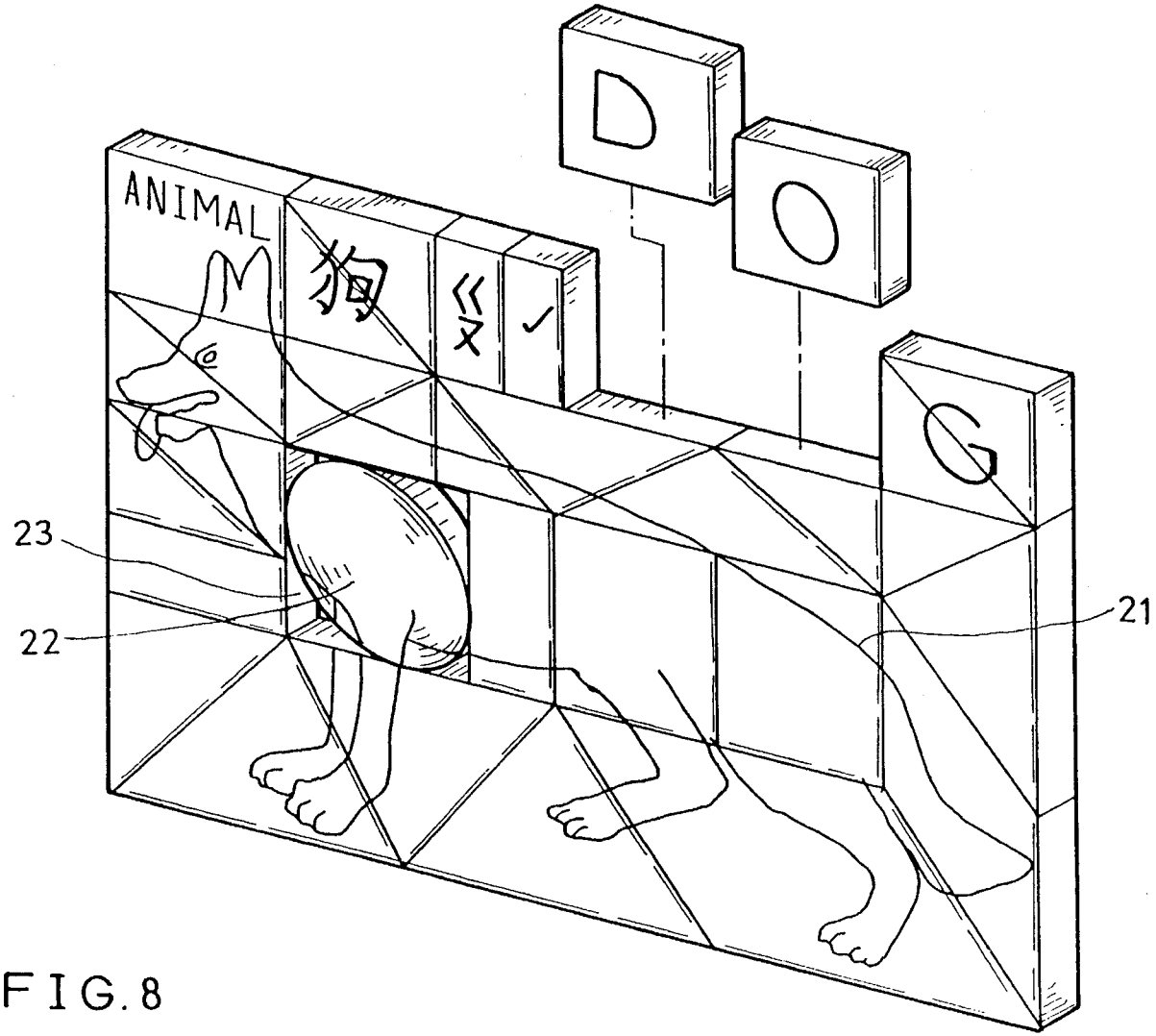
FIG. 8 is a perspective view showing the embodiment in FIG. 7.

FIG. 7 and FIG. 8 shows another embodiment of this invention, the number of layer of building blocks and the pictures combined by the building blocks can be replaced or changed freely according to individual interest.

It is understood by those skilled in the art that the foregoing description is a preferred embodiment of the disclosed device and that various changes and modifications may be made in the invention without departing from the spirit and scope thereof.

What is claimed is:

1. A building block-jigsaw puzzle comprising a case, a first layer of building blocks, a second layer of building blocks and a third layer of building blocks, each said layer of building blocks having a plurality of divided building blocks and placed inside said case, said building blocks of each layer can be combined to form a picture, each said layer of building blocks having respectively a circular building, block, between each said circular building blocks and the other building blocks and situated around said circular building block are some gaps so that each said layer of building blocks can be taken out easily from said gaps, furthermore said first layer of building blocks shoving the title of the picture, as said first layer of building blocks being taken out, player can combined said second layer of building blocks to form a picture the same with the first layer picture, furthermore the second layer picture showing a brief explanation concerning every part of the title, as said second layer of building blocks being taken out, player can combined said third layer of building blocks, therefore player can find the detailed explanation and function to every part of the title in the third layer picture.

* * * * *